United States Patent [19]

Kuhn et al.

[11] 3,992,993

[45] Nov. 23, 1976

[54] SHEET TRANSFER SYSTEM FOR A PRINTING MACHINE

[75] Inventors: Wilfried Kühn, Dresden; Horst Krause, Radebeul, both of Germany

[73] Assignee: VEB Polygraph Leipzig Kombinat fur Polygraphische Maschinen und Ausrustungen, Leipzig, Germany

[22] Filed: Mar. 25, 1975

[21] Appl. No.: 561,675

[52] U.S. Cl. ..... 101/409; 101/232; 271/82

[51] Int. Cl.[2] ..... B41F 21/06

[58] Field of Search ..... 271/82; 101/230–235, 101/407–410

[56] References Cited

UNITED STATES PATENTS

| | | | |
|---|---|---|---|
| 2,092,189 | 9/1937 | Stobb | 101/410 |
| 2,699,941 | 1/1955 | Huck et al. | 101/232 |
| 3,116,923 | 1/1964 | Gunther | 271/82 |
| 3,455,547 | 7/1969 | Rudolph et al. | 271/82 |
| 3,463,484 | 8/1969 | Rudolph | 101/409 |
| 3,537,391 | 11/1970 | Mowery et al. | 101/230 |
| 3,788,639 | 1/1974 | Bru | 101/409 |
| 3,796,154 | 3/1974 | Weisgerber | 101/232 |
| 3,865,362 | 2/1975 | Luffy et al. | 271/82 |

*Primary Examiner*—Clifford D. Crowder
*Assistant Examiner*—William Pieprz
*Attorney, Agent, or Firm*—Michael J. Striker

[57] ABSTRACT

A printing machine has an upstream and a downstream printing station each provided with a printing roller. A sheet transfer roller is located between the stations for transferring sheets from the printing roller of the upstream station to that of the downstream station; it defines a tangent point with the printing roller of the upstream station. A first and a second mechanical gripper system are mounted on the transfer roller for swinging movement towards and away from one another. A suction gripper system is also provided on the transfer roller for engaging a trailing edge portion of a sheet on the periphery of the printing roller of the upsteam station, prior to arrival of the trailing edge of the sheet at the tangent point, and for lifting the trailing portion off the periphery. A drive is provided for effecting movement of the suction gripper system subsequent to engagement of the trailing edge portion of the sheet in a trochoidal path to a position at which the trailing edge portion is engaged by the first mechanical gripper system in preparation for transfer to the second mechanical gripper system, without the movement causing any relative displacement between the remainder of the sheet and the periphery.

4 Claims, 10 Drawing Figures

SHEET TRANSFER SYSTEM FOR A PRINTING MACHINE

BACKGROUND OF THE INVENTION

The present invention relates to a printing machine, and more particularly to a printing machine including a sheet transfer roller which transfers sheets between the printing rollers of an upstream and a downstream printing station.

It is known to provide printing machines having two or more printing stations, with sheet transfer rollers which transfer sheets from a printing roller of an upstream printing station to the printing roller of the next or downstream printing station. German Pat. No. 81,406 teaches a construction in which the sheet on the printing roller of the upstream printing station is engaged at the tangent point defined between this roller and the sheet transfer roller, by a suction gripper system which is movable in direction of the periphery of the transfer roller, and which tensions the sheet. After the tangent point is left, a first mechanical gripper system engages the sheet, taking it over from the suction gripper system at the periphery of the sheet transfer roller. Thereupon, the first gripper system tilts or pivots inwardly of the periphery of the sheet transfer roller and yields the sheet to the second mechanical gripper system which then tilts outwardly and hands the sheet over to a gripper on the printing roller of the downstream printing station.

This construction is generally satisfactory up to a certain printing speed. However, when certain types of sheets are being printed, and when the printing speed amounts to values on the order of 8,000 sheets per hour, deviations may occur in the position of the sheets from the desired position due to the fact that the suction gripper system must pull the sheet so as to cause it to perform a movement relative to the direction of rotation of the printing cylinder from which it takes over the sheet.

Furthermore, since the sheet is guided by the suction gripper system, once it has been engaged by the same, to a zone outside the tangent point of the first printing roller and the sheet transfer roller, the so-called tilting angle (i.e. the angle between the suction surface of the suction gripper system and the remainder of the sheet which is still on the periphery of the first printing roller) is very large, so that if the sheet is of a relatively stiff material and if the machine operates at high speed, the sheet may flex off the suction surface of the suction gripper system, so that it will not be in its desired position at the time the first mechanical gripper system is ready to engage the sheet.

SUMMARY OF THE INVENTION

It is a general object of the invention to provide an improved printing machine which will operate with great reliability even at high operating speeds.

In keeping with these objects, and with others which will become apparent hereafter, one feature of the invention resides in a printing machine which, briefly stated, comprises an upstream and a downstream printing station each having a printing roller. A sheet transfer roller is located between the stations for transferring sheets from the printing roller of the upstream station to the printing roller of the downstream station; the sheet transfer roller defines a tangent point with the printing roller of the upstream station. A first and a second mechanical gripper system on the transfer roller are mounted for swinging movement towards and away from one another. A suction gripper system is also provided on the transfer roller for engaging a trailing edge portion of a sheet on the periphery of the printing roller of the upstream printing station prior to arrival of the trailing edge portion at the tangent point, and for lifting the trailing edge portion off the periphery. Drive means is provided for effecting movement of the suction gripper system subsequent to engagement of the trailing edge portion in a trochoidal path to a position at which the trailing edge portion is engaged by the first mechanical gripper system latest on arrival at the tangent point in preparation for transfer to the second mechanical gripper system, without such movement causing any relative displacement between the remainder of the sheet and the periphery of the printing roller of the upstream printing station.

The machine according to the present invention assures that a minimum tilting angle is maintained at all times, and that yet even at high-speed operation there will be no deviation in the position of the respective sheets from their desired position and orientation.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENT

Figure 1:
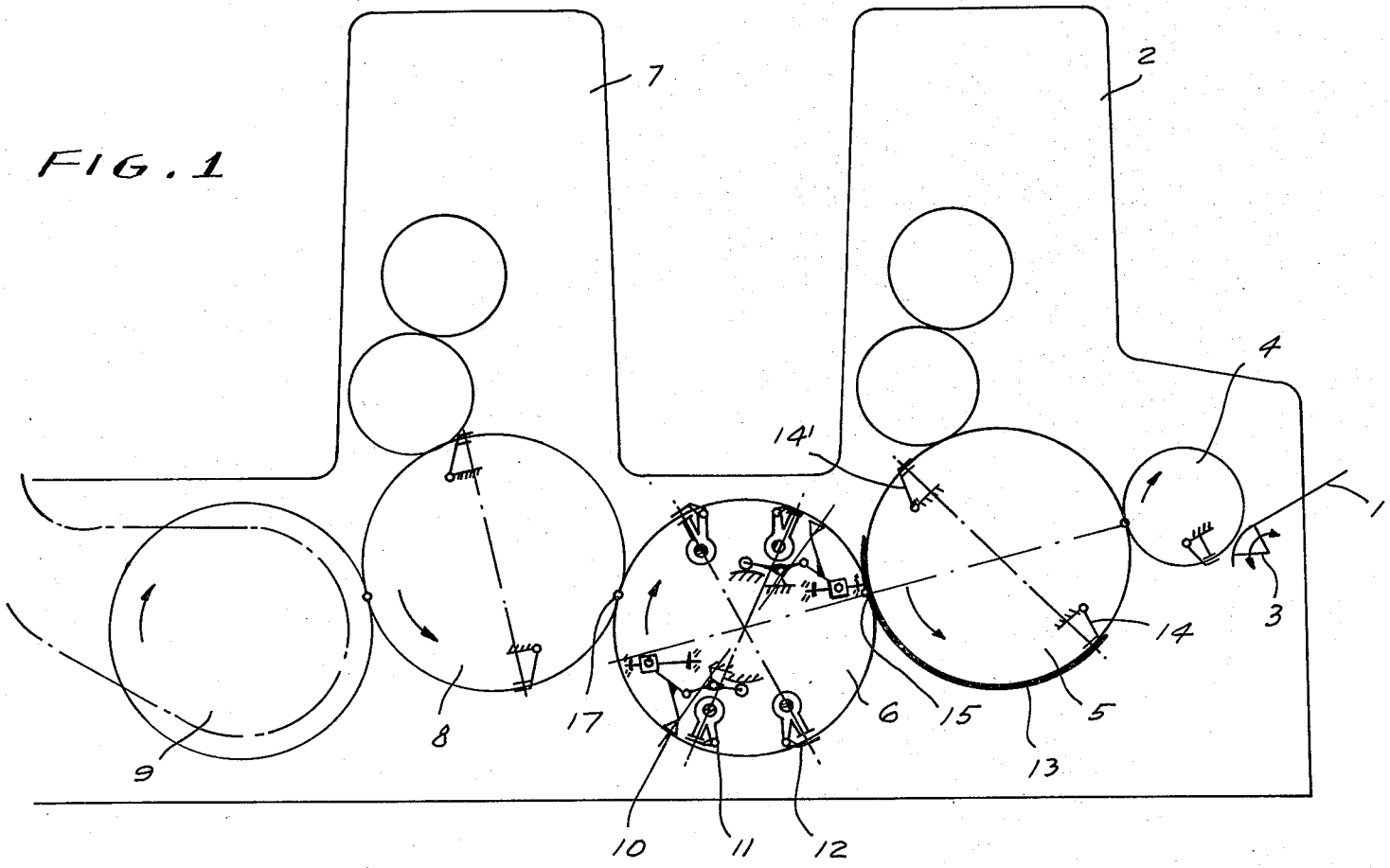
FIG. 1 is a diagrammatic side view illustrating a multi-station rotary printing machine having a sheet transfer arrangement according to the invention.

FIG. 1 illustrates diagrammatically a multi-station printing machine embodying the invention. The printing machine has an upstream printing station 2 and a downstream printing station 7. The upstream station 2 has a printing roller 5 on which one side of a sheet 13 is to be printed, whereupon the sheet is to be turned side-for-side and transferred to the printing roller 8 of the printing station 7, so that its other side may be printed. A feed table 1 is provided where the sheets are fed into the machine, via a feeding device 3 which supplies the sheets to an input roller 4 from where the sheets then travel onto the periphery of the first printing roller 5. In the printing roller 5, the sheets are engaged by a conventional gripper system 5' or 5'' and then travel around with the roller 5. From the roller 8, the sheets are discharged to a discharge device 9.

The transfer of the sheets from roller 5 to roller 8 is effected via the sheet transfer roller 6. The latter is provided with a suction gripper system 10 and with first and second mechanical gripper systems 11 and 12. The drive of the gripper systems 11 and 12 which tilt or pivot towards and away from one another in a manner still to be described later, may be effected in conventional manner, for example by the means disclosed in U.S. Pat. No. 3,455,547.

Figure 10:
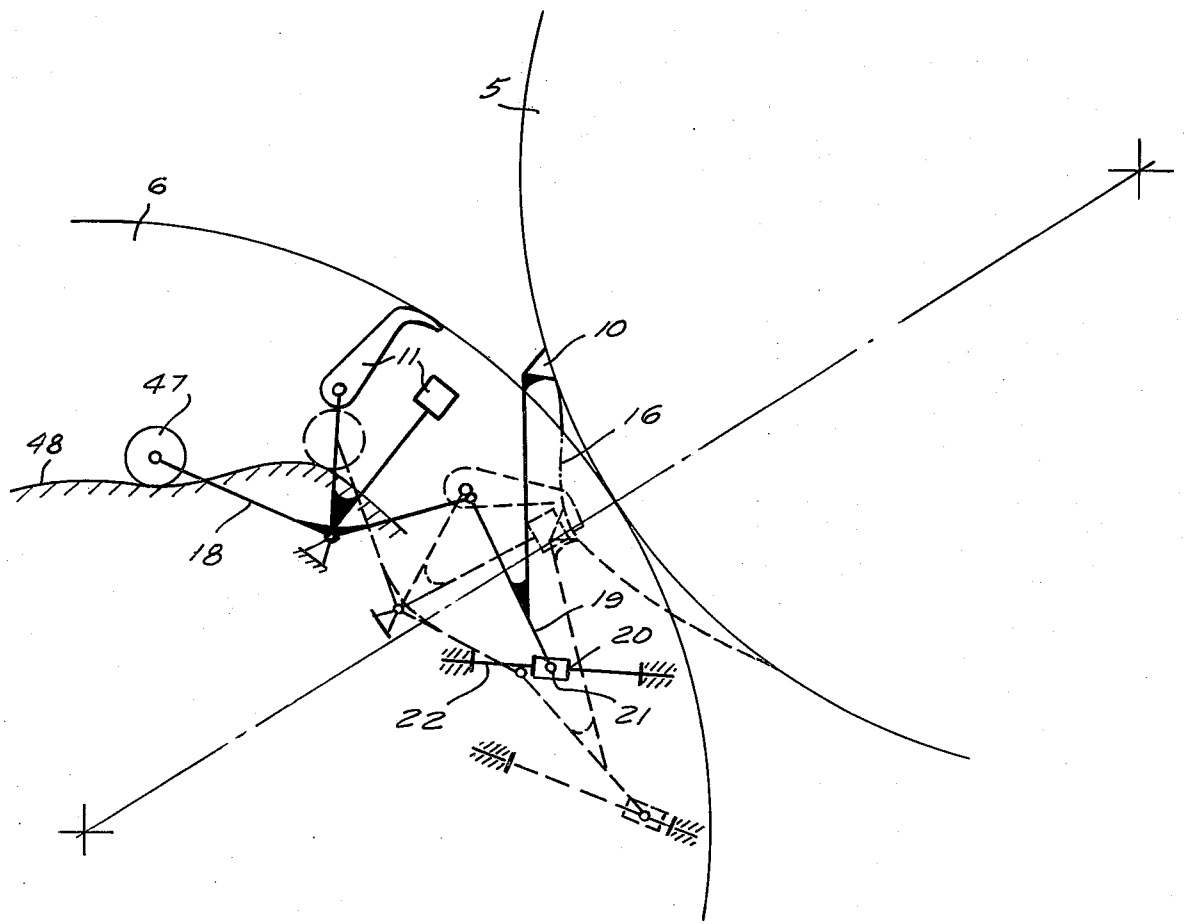
FIG. 10 is a view analogous to FIG. 9 but showing still an additional embodiment of the drive.

The suction gripper system 10 is driven by a drive which makes it possible to move the suction gripper system 10 in a trochoidal path 16 (compare FIG. 10).

The present invention utilizes the use of any one of the three drives which are disclosed in FIGS. 6–10.

A first one of these drives, any one of which can be used in the machine of FIG. 1, shows a cam-controlled linkage drive 31, 36, 30, 32 and 33. This drive is shown in greater detail in FIG. 7, and also in FIG. 8 which is the top-plan view of FIG. 7 but wherein the suction gripper system 10 is shown turned through 180° relative to FIG. 7, for the sake of greater clarity.

Figure 8:
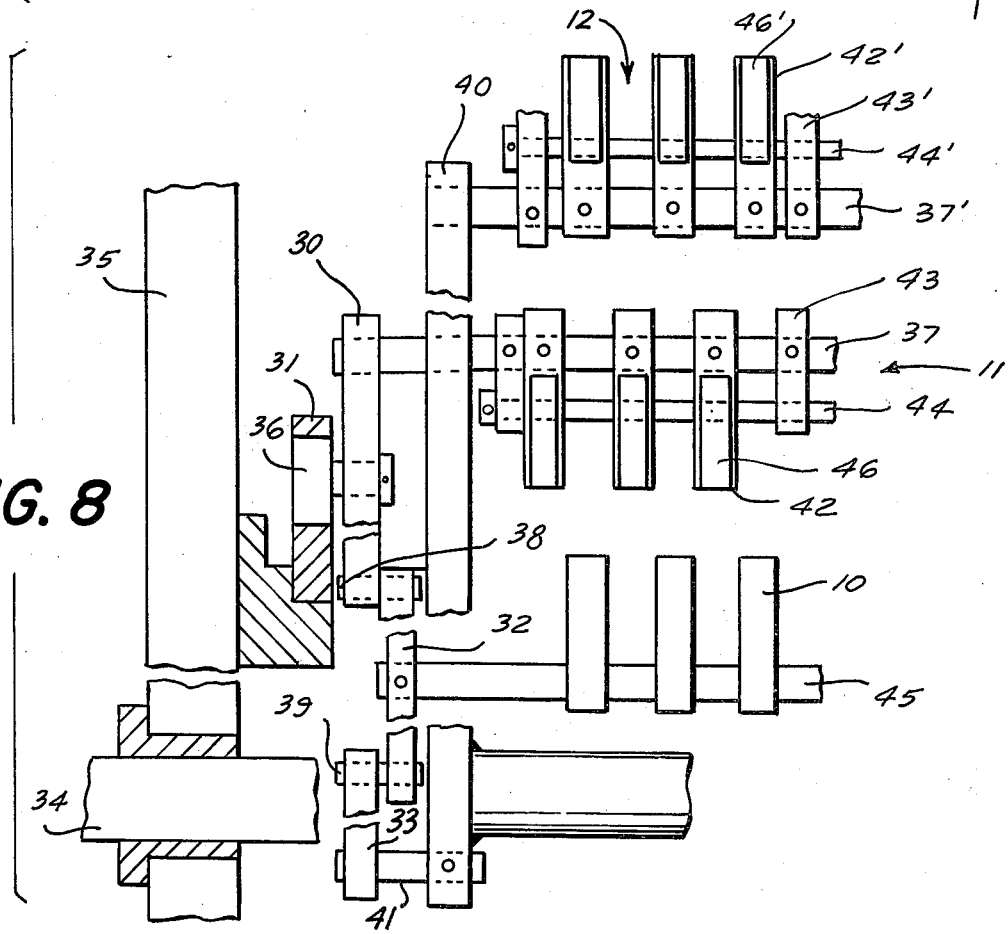
FIG. 8 is a top-plan view of FIG. 7.

It will be seen that in this embodiment the shaft 34 of the sheet transfer roller 6 is journalled for rotation in a side wall 35 of the machine (compare FIG. 8). Also fixedly mounted on the side wall 35, e.g. by means of screw threads, is a cam having a cam groove 31 which cooperates with a cam follower roller 36 that is mounted on an angular lever constituting an input member 30. A link 32 is pivoted to the member 30 and to an output member 33, so that these components together constitute the cam-controlled linkage system 31, 36, 30, 32 and 33. The member 30 is pivoted to a swing shaft 37 of the first mechanical gripper system 11. The link 32, to which the hollow suction shaft 45 carrying the suction system 10 is fixedly secured, is coupled with the member 30 via a first pivot 38 and with the member 33 via a second pivot 39. A pin 41 is fixedly mounted on one of the two axial end plates 40 (only one shown) of the sheet transfer roller 6; it serves as the pivot for the member 33.

The gripper systems 11 and 12 are composed of the swing shafts 37, 37', the gripper shaft holders 43, 43', the gripper shafts 44, 44', the gripper tongues 46, 46' and the gripper abutments 42, 42'. With the drive for the gripper systems 11 and 12, which is supplied via the swing shafts 37, 37', is not illustrated but, as mentioned before, may be in accordance with that disclosed in U.S. Pat. No. 3,455,547.

Figure 9:
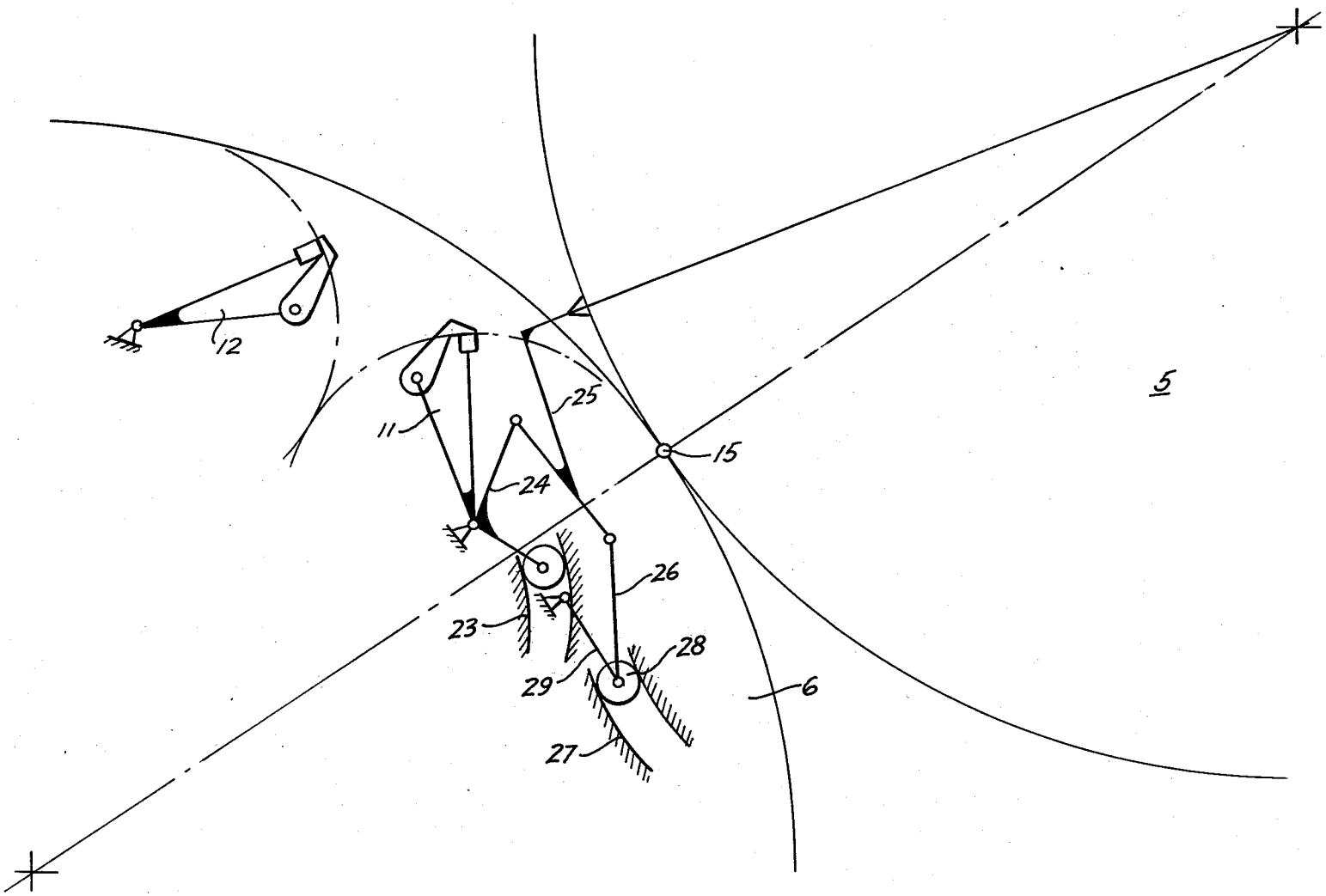
FIG. 9 is a view similar to FIG. 6, illustrating a further embodiment of the drive.

A further drive for the suction gripper system 10 is illustrated in FIG. 9. In this Figure, the drive is a five-bar cam-controlled linkage 23, 24, 25, 26, 28 and 29 with two cam drives. A first cam having a first cam groove 23 is provided, which cam groove is engaged by a follower roller 49 that is mounted on an angled lever 24 which is connected with a link 25 on which the suction gripper system 10 is secured. The link 25 is pivoted to the link 26 at one end of the latter, and at the other end of the link 26, there is secured a further cam follower roller 28 which engages a second cam track 27 and to which is also pivoted a link 29.

The first and second cam tracks 23, 27 are provided on cams which are fixedly mounted on the side wall 35 (which is not illustrated in FIG. 9) of the machine; the other members of the drive are provided on the sheet transfer roller 6.

FIG. 10 shows still another possible drive for effecting the movement of the suction gripper system 10 in a trochoidal path. In this Figure, a linkage 48, 47, 18, 19 and 20 is provided, having a cam track 48, a drive member 18 to which a cam follower roller 47 is secured, a link 19 and a slide member 20. The suction gripper system 10 is mounted on the link 19 in this embodiment. The second mechanical gripper system 12 has been omitted in FIG. 10 for the sake of clarity, but the gripper system 11 has been shown. The slide member 20 is guided for straight-line movement in a guide 22 which is fixedly mounted (e.g. by means of screws) on the sheet transfer roller 6. The pivot point of the member 18 is also the pivot point for the mechanical gripper system 11.

The operation of the printing machine of the present invention will now be described.

A sheet 13 to be printed is supplied via the table 1 to the roller 4 which in turn furnishes it to the printing cylinder 5 where its one exposed side is printed. Thereafter, the grippers 5' or 5'' of the printing roller 5 conduct the now-printed sheet 13 to and through the tangent point 15 defined between the printing roller 5 and the sheet transfer roller 6.

Figure 2:
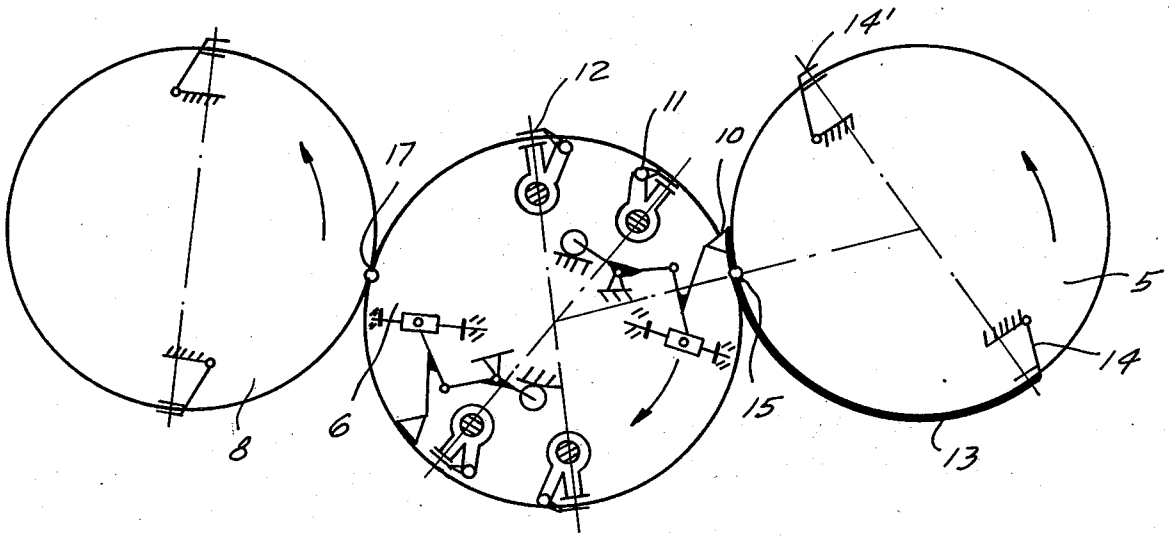
FIG. 2 is a view similar to FIG. 1, but showing a detail of the arrangement in FIG. 1 in a first operating position.

Prior to the movement of the trailing edge of the printed sheet 13 through the tangent point 15, the trailing edge portion of the sheet is engaged by suction gripper system 10, as is shown in FIG. 2. During the continuing rotation of the printing roller 5 and the sheet transfer roller 6, the trailing end portion of the sheet 13 which is engaged by the suction gripper system 10 is made to travel inwardly of the periphery of the printing roller 6 on a trochoidal path 16. As the trailing end portion of the sheet 13 is made to move in this path, it is being "peeled" off the periphery of the printing roller 5, but the major portion of the sheet 13 which is still on the periphery of the printing roller 5 and overlying relationship therewith, remains unchanged, i.e. does not perform any movement relative to the periphery of the printing roller 5.

To obtain this "peeling" action, the trailing end portion of the sheet 13 must be made to perform movement in the trochoidal path 16, by a corresponding movement of the suction gripper system 10. A trochoid is a curve generated by a point on a radius of a circle as the circle rolls on a fixed straight line, for example cycloids and evolvents.

Figure 3:
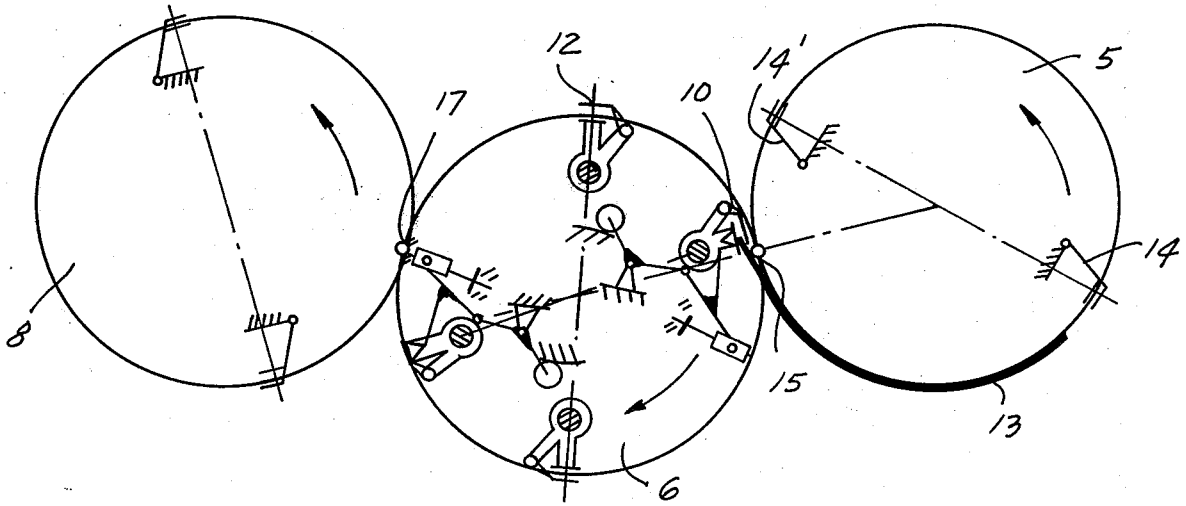
FIG. 3 is analogous to FIG. 2, showing the detail in a second operating position.

Before the trailing end portion of the sheet, engaged by the suction gripper system 10, reaches the tangent point 15, it is transferred by the suction gripper system 10 to the first mechanical gripper system 11, as shown in FIG. 3. This means that at the time at which the direction of movement of the sheet 13 is reversed, that is when the sheet begins to be pulled off the roller 5 and to move onto the roller 6, it is already being transported by the first mechanical gripper system 11 and no longer by the suction gripper system 10. The direction of movement of the sheet 13 begins to be reversed approximately at the time at which the trailing end of the trailing end portion of the sheet 13 is located at the tangent point 15. Since the trailing end portion of the sheet is guided in the trochoidal path 16, the suction gripper system 10 need not exert any pull upon the sheet 13 at all.

Figure 4:
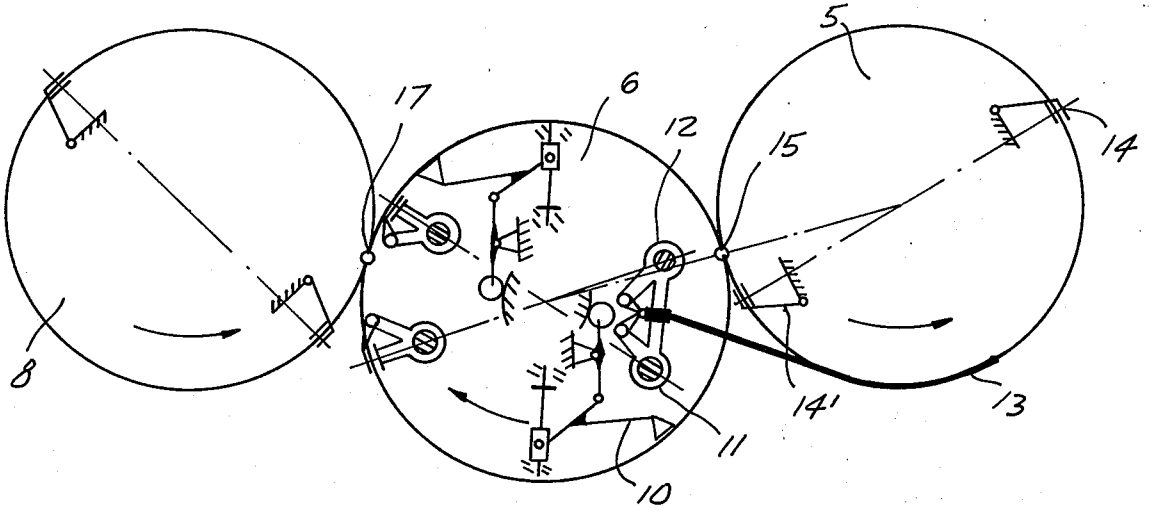
FIG. 4 shows the detail of FIG. 3 in a third operating position.

Once the trailing end portion of the sheet has been engaged by the mechanical gripper system 13, the latter swings towards the second mechanical gripper system 12 to which the trailing end portion is transferred in known manner, as diagrammatically shown in FIG. 4. The drive for the gripper systems 11, 12, and the opening and closing of the gripper systems, can be accomplished with the means disclosed in U.S. Pat. No. 3,455,547 and in U.S. Pat. No. 3,463,484.

Figure 5:
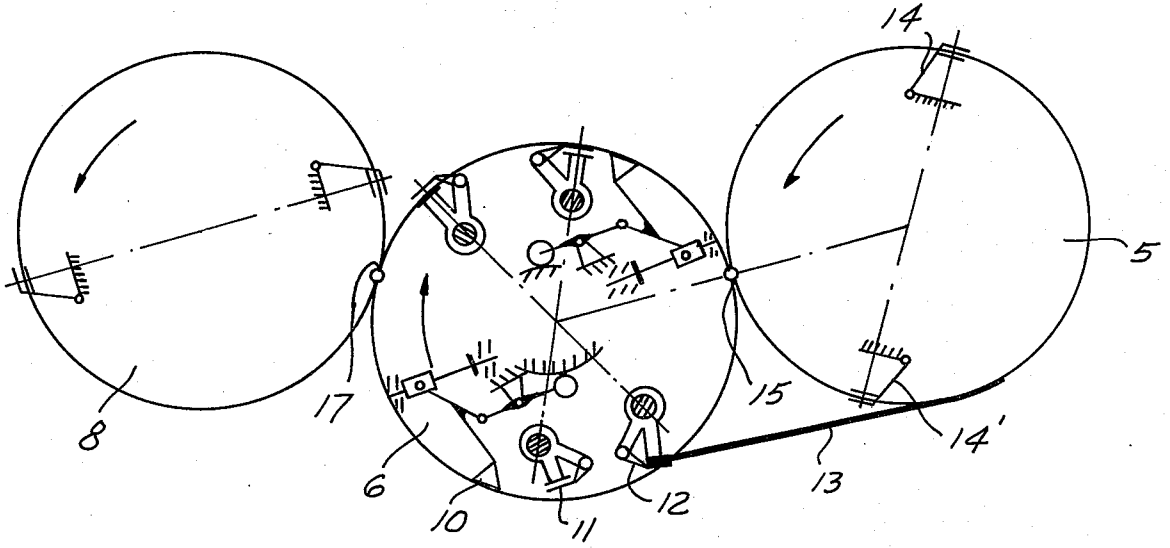
FIG. 5 is an enlarged-scale diagrammatic detail view, showing details of the sheet transfer roller of FIGS. 1–4 with the associated gripper systems.

After the second gripper system 12 has engaged the trailing end portion of the sheet 13, the gripper system 12 swings to the position illustrated in FIG. 5 and, upon reaching the tangent point 17 defined between the transfer roller 6 and the second printing roller 8, the trailing end portion (which is now the leading end portion) of the sheet 13 is yielded to a gripper on the printing roller 8. The other side of the sheet, that is the previously blank side, is now printed in the printing station 7 and subsequently the sheet is discharged via the arrangement 9.

Figure 6:
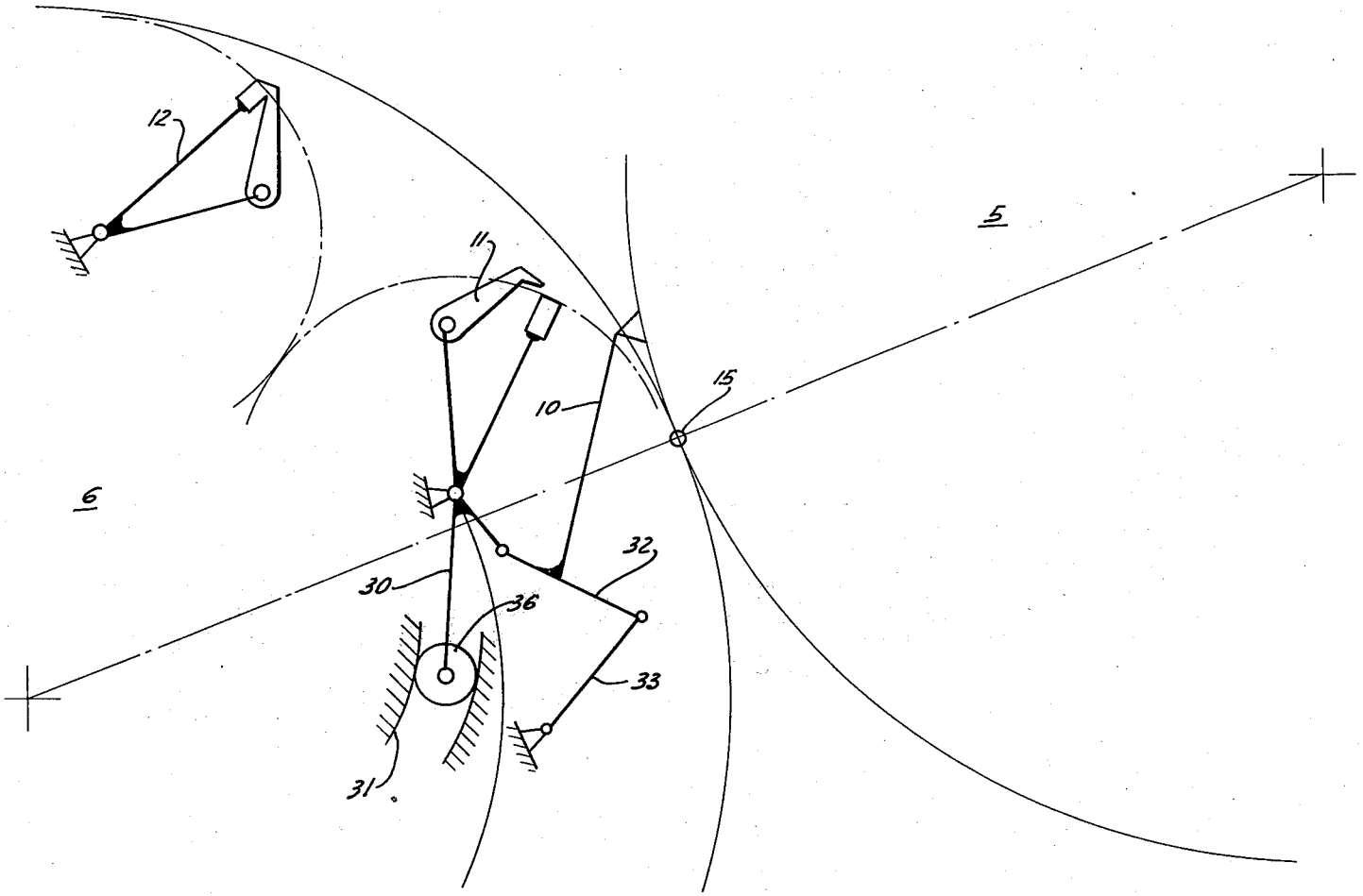
FIG. 6 is a diagrammatic enlarged-scale detail view showing details of one drive arrangement for the gripper system.
Figure 7:
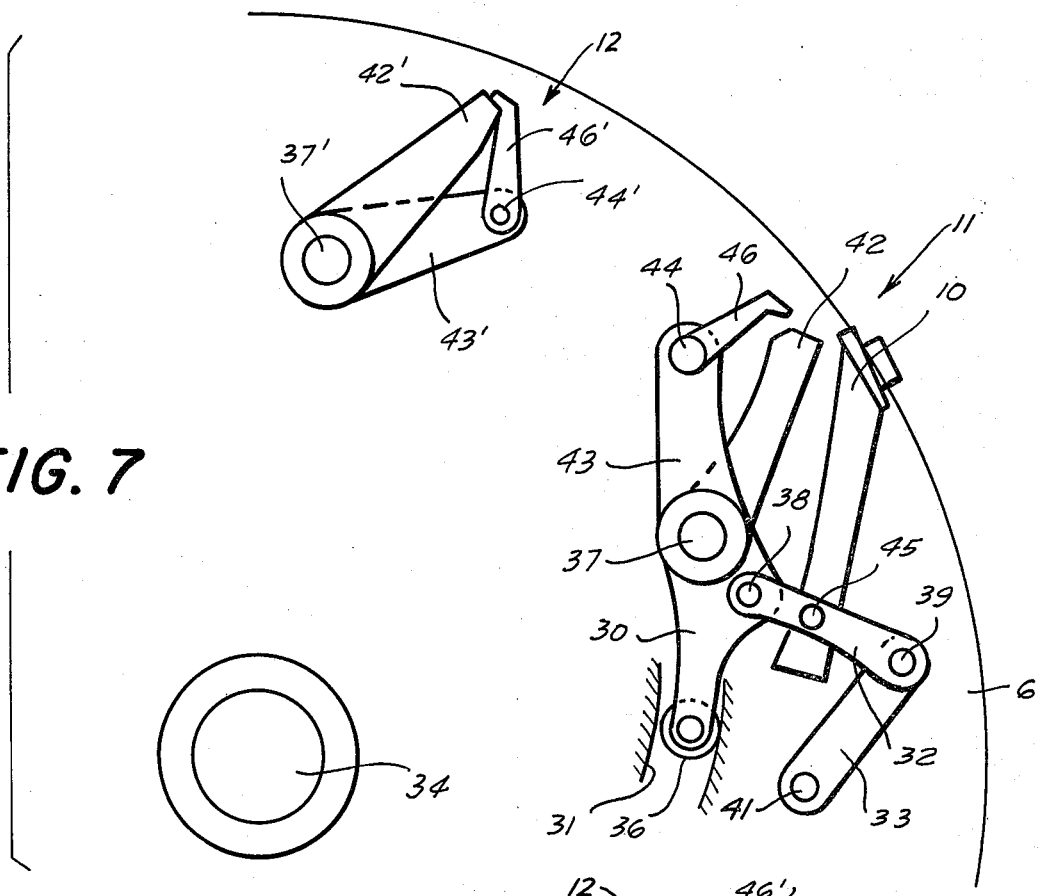
FIG. 7 is a side view of FIG. 6.

The operation of the drive illustrated in FIGS. 6–8 for the suction gripper system 10 is as follows:

During rotation of the sheet transfer roller 6, the follower roller 36 travels in the cam groove 31 which is fixedly provided on the side wall 35 of the machine. Because of this the member 30 which is pivotally connected with the cam follower roller 36, swings about the shaft 37 in accordance with the dictates of the cam groove 31, and transfers movement via the link 32 to the suction gripper system 10, causing the same to travel in a trochoidal path 16.

The operation of the drive illustrated in FIG. 9 for the suction gripper system 10 is as follows:

During rotation of the sheet transfer roller 6, the member 24 is guided in accordance with the configuration of the cam groove 23 via the cam follower roller 39 that travels in the cam groove 23. The link 25, carrying the suction gripper system 10 and pivoted to the member 24, is moved correspondingly. The second link 26 is pivoted to the other end of the link 25 and is also pivoted to the cam follower roller 28 which is provided in the second cam groove 27. The movement which is caused by the travel of the cam follower roller 49 in the cam groove 27 is superimposed upon the movement which is caused by the travel of the cam follower roller 28 in the cam groove 27, causing a composite movement which makes the suction gripper system 10 travel in a trochoidal path in the operating phase subsequent to engagement of the trailing edge portion of the sheet 13 by the suction gripper system 10 and until this trailing edge portion is yielded to the first mechanical gripper system 11.

Finally, the operation of the drive illustrated in FIG. 10 for making the suction gripper system 10 travel in a trochoidal path, is as follows:

The follower roller 47 travels in the cam groove 48; this causes the member 18 to pivot about the pivot point which is common to the member 18 and to the first gripper system 11, and the link 19 which is pivoted to the member 18 performs a movement between the members 18 and 20 about the pivot point 21, and a shifting movement in the direction of the straight-line guide 22. The positions assumed by the suction gripper system 10 and the first mechanical gripper system 11 are shown in two orientations in FIG. 10. In the first orientation, the suction gripper system 10 has contacted the trailing edge portion of the sheet 13 on the periphery of the first printing cylinder 5 ahead of the tangent point 15 (i.e. before the tangent point 15 is reached) and moves the trailing edge portion into the second position which is shown in broken lines. During the movement from the first to the second position, the suction gripper system 10 performs a movement in a trochoidal path 16, in accordance with the present invention.

It will be understood that each of the elements described above, or two or more together, may also find a useful application in other types of constructions differing from the types described above.

While the invention has been illustrated and described as embodied in a printing machine, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characterstics of the generic or specific aspects of this invention.

What is claimed as new and desired to be protected by Letters Patent is set forth in the appended claims.

We claim:

1. In a printing machine, a combination comprising an upstream and a downstream printing station each having a printing roller; a sheet transfer roller between said stations for transferring sheets from the printing roller of said upstream station to the printing roller of said downstream station, said sheet transfer roller defining a tangent point with the printing roller of said upstream station; a first and a second mechanical gripper system on said transfer roller, mounted for swinging movement towards and away from one another; a suction gripper system on said transfer roller; actuating means for effecting engagement of said suction gripper system with a trailing edge portion of a sheet on the periphery of the printing roller of said upstream station prior to arrival of said trailing edge portion at said tangent point, and for effecting lifting of said trailing edge portion off the periphery; means mounting said suction gripper system for movement on said transfer roller in a trochoidal path; and drive means for effecting movement of said suction gripper system subsequent to engagement of said trailing edge portion, in said trochoidal path to a position at which said trailing edge portion is engaged by said first mechanical gripper system in the region of said tangent point in preparation for transfer to said second mechanical gripper system, with out said movement causing any relative displacement between the remainder of said sheet and said periphery.

2. A combination as described in claim 1, wherein said drive means comprises a cam-controlled linkage including a cam having a cam groove, a pivot, an angled lever pivotable about said pivot, a follower roller on said lever and engaging said cam groove, a first link pivoted at one end to said lever and having said suction gripper system connected thereto, and a second link pivoted to the other end of said first link and to a said transfer roller.

3. A combination as defined in claim 1, wherein said drive means comprises a first and a second cam groove, a pivot, an angled lever pivotable about said pivot, a first follower roller on said angled pivot lever and engaging said first cam groove, a first link having one end pivoted to said lever and having said suction gripper system connected thereto, a second link having one end portion pivoted to the other end of said first link, a second follower roller pivoted to the other end portion of said second link and a third link pivoted at its opposite ends to said transfer roller and to said other end position of said second link, respectively.

4. A combination as defined in claim 1, wherein said drive means comprises a cam having a curved cam track, a linkage including a first member having one end pivoted to a cam follower roller and another end pivoted to a first end of a link to which said suction gripper system is connected, a slidable member pivoted to a second end of said link, and a guide which guides said slidable member for movement in a straight-line path.

* * * * *